United States Patent [19]

Hannifin

[11] Patent Number: 4,856,793

[45] Date of Patent: Aug. 15, 1989

[54] CONTINUOUS SOUND MAKING BOOMERANG

[76] Inventor: Matt B. Hannifin, 2307 Gulf, Midland, Tex. 78791

[21] Appl. No.: 171,406

[22] Filed: Apr. 4, 1988

[51] Int. Cl.[4] ..... A63B 65/08

[52] U.S. Cl. ..... 273/426; 446/47

[58] Field of Search ..... 273/426, 424, DIG. 27; 446/47; 429/96–100

[56] References Cited

U.S. PATENT DOCUMENTS

| | | | |
|---|---|---|---|
| 2,035,629 | 3/1936 | Wing | 273/426 X |
| 3,138,491 | 6/1964 | Rubio | 429/97 |
| 3,403,910 | 10/1968 | Claycomb | 273/426 |
| 3,710,505 | 1/1973 | Linenfelser | 273/424 |
| 4,080,753 | 3/1978 | Hiner et al. | 273/424 X |
| 4,114,885 | 9/1978 | Morrow | 273/424 |
| 4,134,229 | 1/1979 | Lehman | 446/47 |
| 4,135,324 | 1/1979 | Miller et al. | 446/47 |
| 4,196,540 | 4/1980 | Hembree et al. | 273/424 X |
| 4,421,320 | 12/1983 | Robson | 273/426 X |

FOREIGN PATENT DOCUMENTS

| | | | |
|---|---|---|---|
| 735649 | 6/1966 | Canada | 273/426 |

OTHER PUBLICATIONS

Aids & Appliances, Eighteenth edition, 7-1972-6-1973, p. 10, Aud-A-Ball.

Washington Post, 10/24/82, pp. A1, A16; 10/25/82, pp. A1, A10, "A Season of Light", parts 1 & 2.

Radio-Electronics, 12-1971, p. 14, Baseballs Sound Off.

*Primary Examiner*—Paul E. Shapiro

*Attorney, Agent, or Firm*—Kenneth C. Hill

[57] ABSTRACT

A boomerang includes an apparatus to continuously generate audible sound. The generator is located centrally so that flight characteristics of the boomerang are not adversely affected. A resilient member holds a battery in place during use so that the sound does not cease until desired by the user. The resilient member allows the battery to be retained in a rest position in its holder when no sound is desired.

1 Claim, 4 Drawing Sheets

CONTINUOUS SOUND MAKING BOOMERANG

BACKGROUND OF THE INVENTION

1. Field of the Invention

The field of art to which this invention pertains is boomerang projectiles.

2. Description of the Prior Art

In the prior art toys that made noises did not have the capacity for returning to the thrower. Within U.S. Pat. No. 4,080,753 an alternate embodiment of a conventional boomerang shape is described, but the flight path illustrated and described is clearly non-returning. The preferred embodiment for a flying saucer uses a buzzer which only produces sound while rotating. This same lack of continuous sound production is true of several throwing balls in U.S. Pat. Nos. 1,187,838; 1,193,992; 620,084; 163,086; 2,687,302; 1,628,717; and 3,395,462 which would not continue to produce sound long enough to retrieve from under parked cars or dislodge from a tree, which would be crucial to the visually impaired individual.

In the prior art toys that performed as a true boomerang, flew largely parallel to the ground on a flight path generally describing a circle and returned to the thrower, but did not produce a continuous sound. Visually impaired individuals, therefore, could not perceive the location of such boomerangs nor reasonably partake in the sport.

In the prior art many things are considered boomerangs. Many objects referred to as boomerangs do not have the capability of returning to the starting point exhibited by true boomerangs. The flight of the boomerang requires a delicate balance of forces to fly in the circular path described by FIG. 10 where the user 50 throws the boomerang 40 at tilt that is largely vertical as opposed to the horizontal orientation for optimum performance of disks referred to as "Frisbees."

The physical principles involved include:

(1) The lift force created by an airfoil slicing through the air. As shown in FIG. 8, as the air foil 32 travels toward point W, the air is forced to pass above and below the airfoil 32. The air passing over the airfoil 32, i.e. point X, is rarified because the same quantity of air passes above and below, but travels a larger distance passing above the airfoil 32. This reduces the air pressure at point X such that the pressure at Y is greater causing a force in direction S.

(2) As the boomerang is thrown forward while spinning, the airfoil in the upper position V always passes through more air because it is both rotating and translating into oncoming air. The airfoil at position U therefore experiences less lift force.

(3) As seen in FIG. 11, a side view of the rotating boomerang, the greater force on the upper portion of the rotating boomerang causes a perpendicular twisting force about the axis that runs from top to bottom. This torque I, is often referred to as "gyroscopic precession" and is a result of the conservation of angualr momentum.

SUMMARY OF THE INVENTION

A boomerang includes an apparatus to continuously generate audible sound. The generator is located centrally so that flight characteristics of the boomerang are not adversely affected. A resilient member holds a battery in place during use so that the sound does not cease until desired by the user. The resilient member allows the battery to be retained in a rest position in its holder when no sound is desired.

DESCRIPTION OF THE PREFERRED EMBODIMENTS

Figure 1:
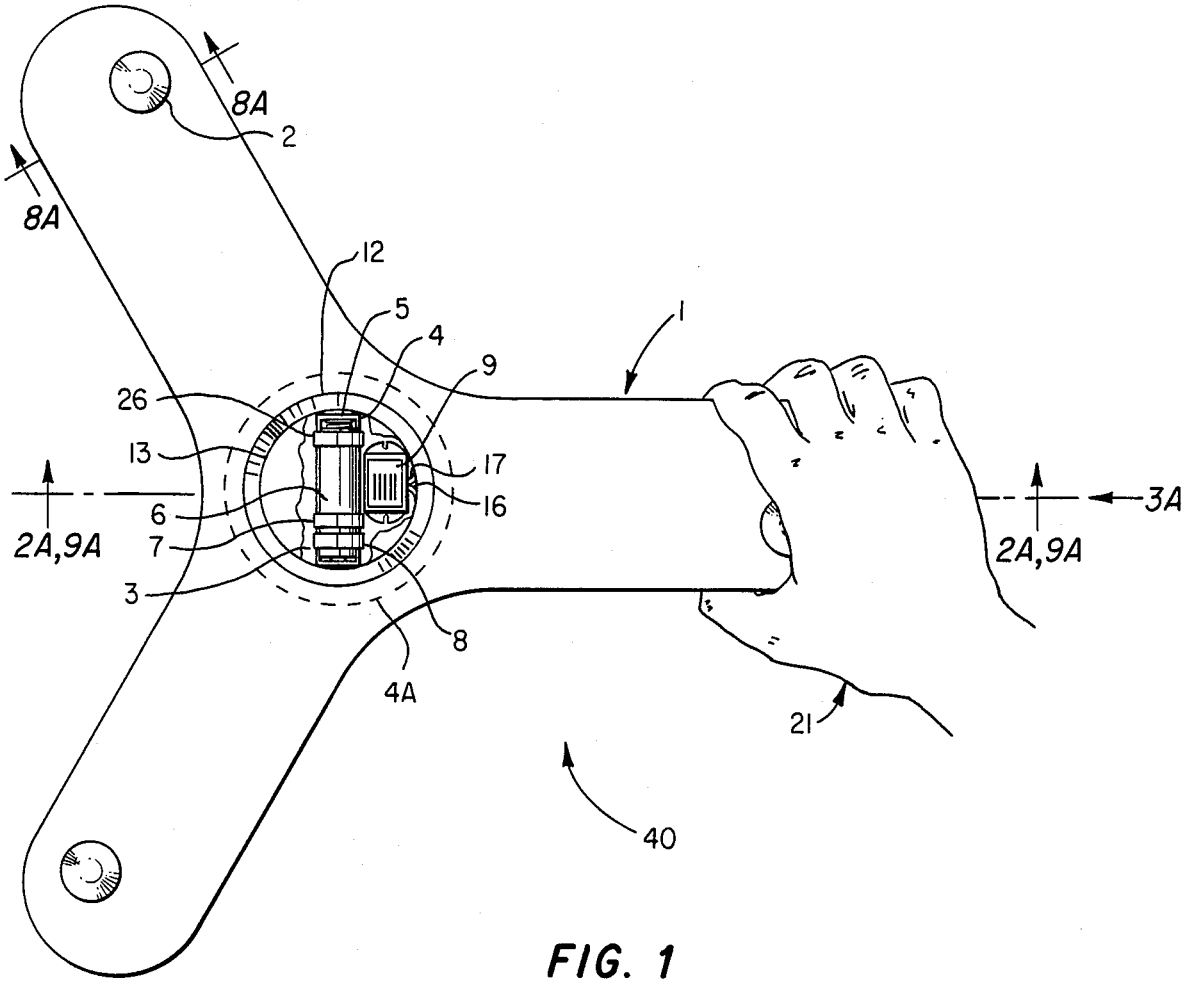
FIG. 1 is a bottom view of apparatus 40 showing the thrower's hand, taken along the direction of arrow 1B of FIG. 2.
Figure 2:
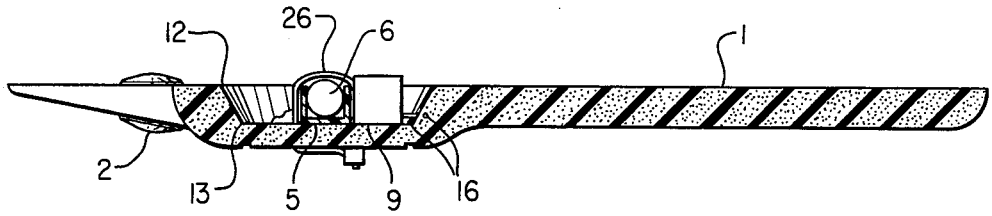
FIG. 2 is a transverse cross-sectional view taken along the symmetrical vertical section 2A–2A of FIG. 1.
Figure 3:
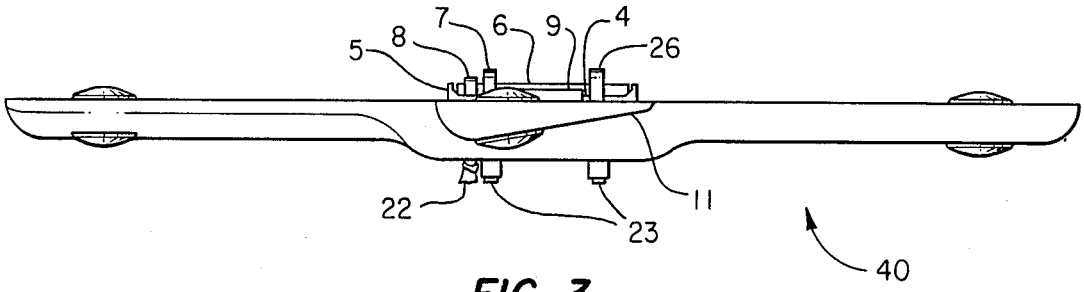
FIG. 3 is a side view of the apparatus 40 taken along the direction of the arrow 3A of FIG.1.
Figure 4:
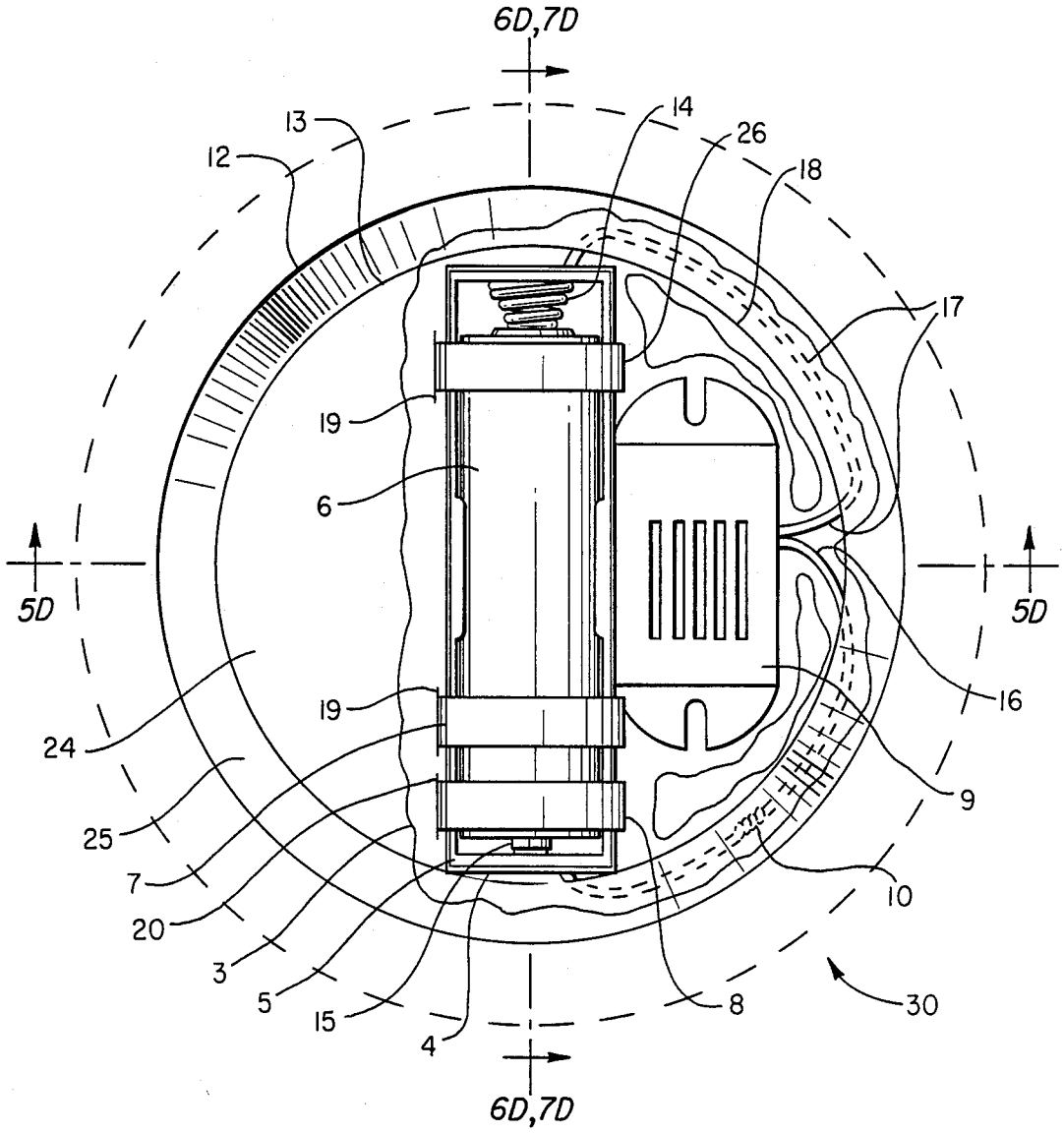
FIG. 4 is a bottom view of the sound producing assembly, taken from a magnification of the circular section of FIG. 1.
Figure 5:
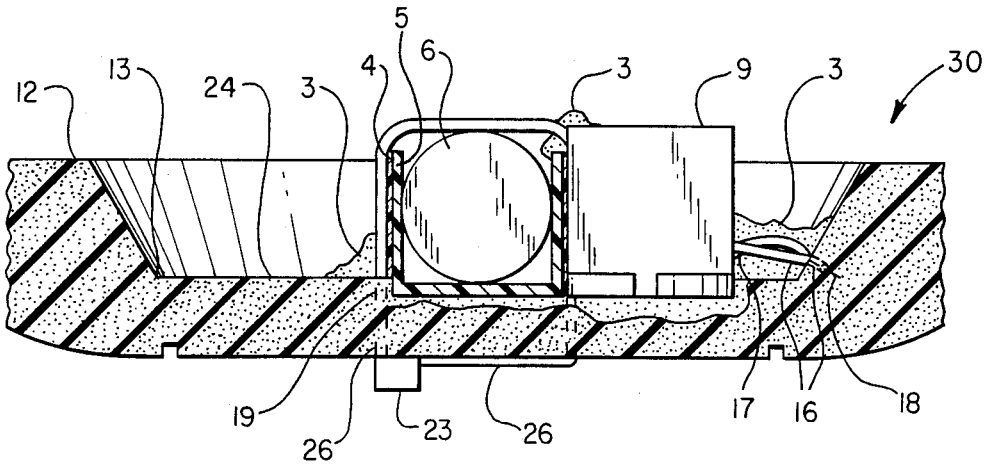
FIG. 5 is a transverse cross-section view of the vertical section 5D–5D of FIG. 4.
Figure 6:
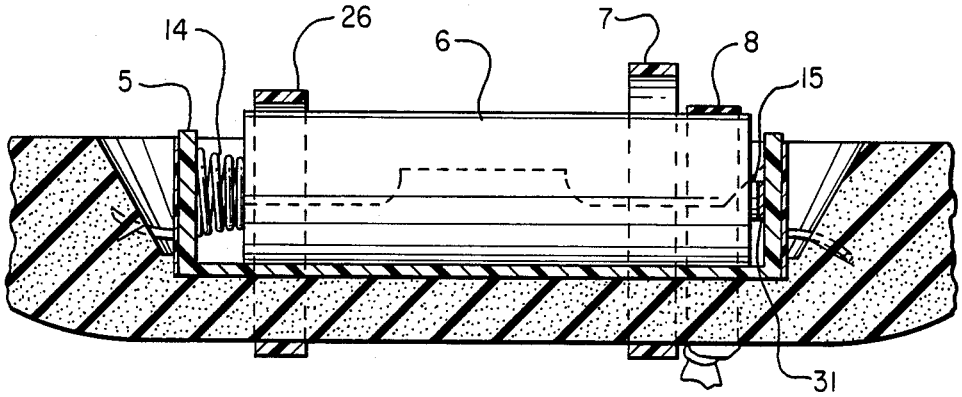
FIG. 6. is a transverse cross-section view of the vertical section 6D–6D of FIG. 4 with the battery in the power ON position.
Figure 7:
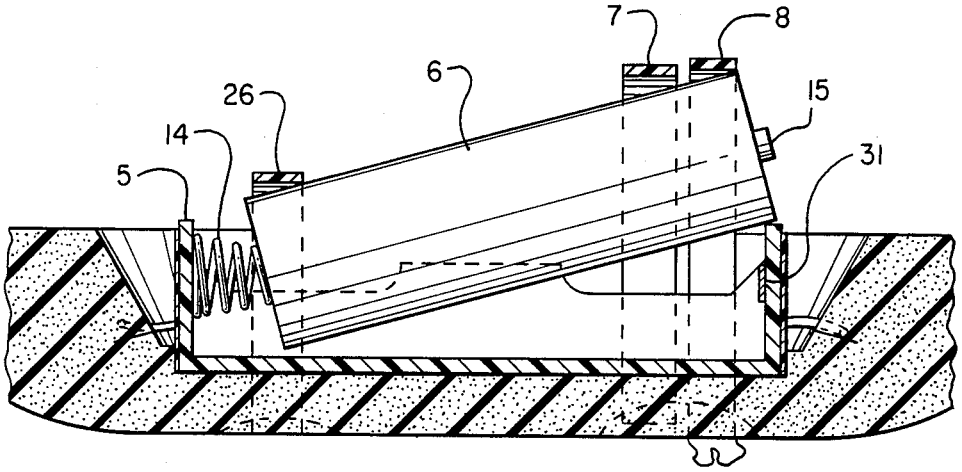
FIG. 7 is a transverse cross-section view of the vertical section 7D–7D of FIG. 4 with the battery in the power OFF position.
Figure 8:
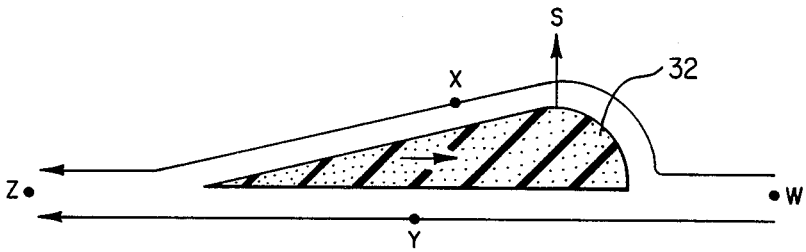
FIG. 8 is a transverse cross section view of the vertical section 8A–8A of FIG. 1.
Figure 9:
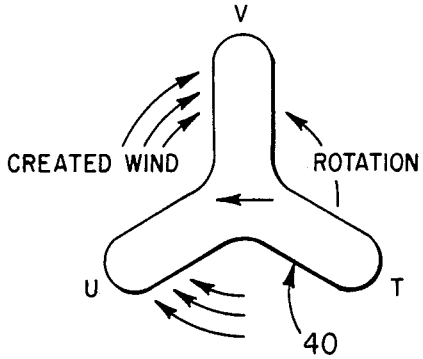
FIG. 9 is a top view of the apparatus 40 as seen after turning 180° along the axis 9A in FIG. 1.
Figure 10:
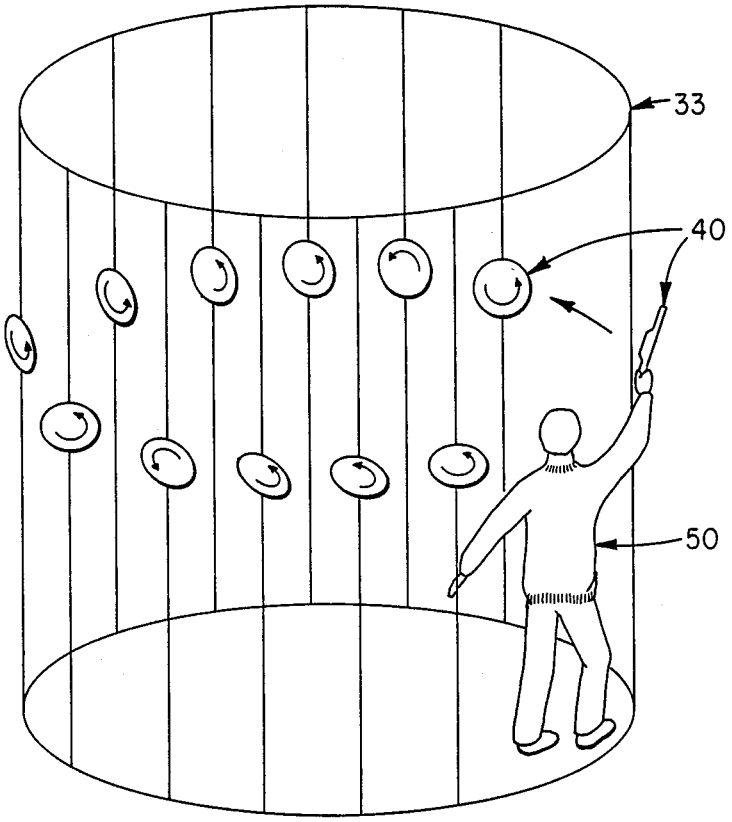
FIG. 10 is a schematic representation of the flight of this invention.
Figure 11:
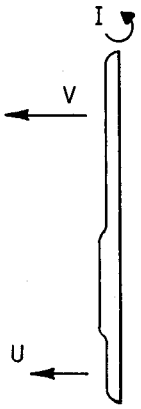
FIG. 11 is a schematic representation of the unbalanced lift forces acting on the boomerang.

The apparatus 40 according to this invention comprises a boomerang 1 and a sound producing assembly 30. In operation the apparatus 40 is manipulated by an operator 50 as shown in FIG. 10.

The boomerang 1 comprises three airfoils extending radially from a central cup. The airfoils 27, 28, 29 are separated uniformly by three 120° angles to form an overall "Y" shape with the cup (made up of 24 and 25) in the center. Toward the outer ends of the airfoil are wing weights which increase the moment of inertia and thus decrease the effects of wind drag. The material of the boomerang 1 is a resilient foam plastic which cushions impacts with the user and damaging shock to the sound producing assembly 30.

The sound producing assembly 30 comprises, in operative combination, a cup (made of base 24 and skirt 25), a buzzer 9, an electrical source or battery 6, and a battery holder 5. The electrical components 9, 6, and 5 of the sound producing assembly 30 are fixedly attached to the cup base 24. The battery holder 5, is held below the base 24 surface in a groove, by epoxy 3 and by the battery 6. Said battery is under tension of a plastic strap 26 and a rubber band at all times and by a second plastic strap when electrically switched off. The battery holder 5 is additionally reinforced with fiberglass reinforced adhesive tape 4 wrapped around said battery case perimeter. The buzzer 9 is held fixed, embedded into the surface of the cup base 24 and affixed to the side of the battery holder 5 by epoxy 3. The wires from the terminals of the battery holder 5 are fastened by solder 10 to the wires 16, 17 of the buzzer 9. Said wires are embedded inside the cup skirt 25 by insertion into a thin cut slit 18 running along said skirt.

The electrical power to the buzzer 9 is cut off by applying a pulling force to the positive terminal 15 end of the battery perpendicular to the cup base 24, away from the boomerang. The compression force of the battery holder spring 14 assists to balance the tension forces of the rubber band 8 and plastic straps 7, 26 to allow the battery 6 to not be pulled back to the power ON position once the outside diameter of the positive end of said battery rests on the upper edge of the battery holder 5. The user may slap the apparatus 40 toward the opposite hand against the force of the rubber band 8 to cause the same power cut off in one quick motion. The battery 6 may be removed for replacement or long term storage from this power OFF position. This design eschews breakdowns in a separate switch.

The fasteners 7, 26 and 8 all act to protect the sound producing assembly and the user. The plastic straps 7, 26 and rubber band 8 act as skid guards on rough surfaces and help isolate the user from the heavy battery.

It will be understood that various other changes of the details, materials, steps, arrangement of parts and uses which have been herein described and illustrated in order to explain the nature of the invention will occur to and may be made by those skilled in the art upon reading of this disclosure, and such changes are intended to be included within the principles and scope of this invention. These changes may include, but are not limited to: (1) use of other battery hold-down elastic and straps; (2) other forms of wing weights; (3) replacement of buzzer with integrated circuitry to produce music; (4) the addition of a manual power switch; (5) the addition of a sound activated beeping device; (6) the use of left-handed as well as right-handed versions; (7) a change in the number of airfoils; (8) an outer ring around the outside periphery; (9) the use of a different type of power source including solar cells; or (10) relocation of the buzzer so that sound is broadcasted from the opposite side of the boomerang.

I claim:

1. A boomerang with a continuous sound producing assembly comprising:

a central cup area three airfoils extending radially from said cup area at 120° spacing about said cup area:

wing weights attached near the outer ends of each airfoil;

said cup area and airfoils being formed from a light weight resilient material, and;

a continuous sound producing assembly having;

a cup;

a battery holder with one open side, a pair of electrical contacts, and reinforced with fiberglass reinforced adhesive tape, held in said cup by two plastic straps;

a battery for mounting inside said holder with its opposite poles in contact with said contacts;

a buzzer fixedly mounted to the base of said cup;

a first wire connecting one contact of said holder directly to a first electrical contact on said buzzer and a second wire connecting the other contact of said holder directly to a second electrical contact on said buzzer whereby when said battery is mounted in said holder with its poles in contact with said holder contacts a circuit is completed with said buzzer to cause it to continuously emit sound; and a resilient band stretched across the open side of the holder for biasing the battery into contact with said holder contacts, said resilient band permitting at least one pole of said battery to be manually lifted out of contact with its holder contact and permitting a portion of said battery to be positioned to rest on said holder adjacent said opening and biasing said battery to maintain it in said rest position with said pole out of contact with said holder contact whereby said circuit is maintained open.

* * * * *